US005833538A

United States Patent [19]

Weiss

[11] Patent Number: 5,833,538

[45] Date of Patent: Nov. 10, 1998

[54] AUTOMATICALLY VARYING MULTIPLE THEORETICAL EXPECTATIONS ON A GAMING DEVICE: APPARATUS AND METHOD

[75] Inventor: Steven A. Weiss, Las Vagas, Nev.

[73] Assignee: Casino Data Systems, Las Vegas, Nev.

[21] Appl. No.: 700,007

[22] Filed: Aug. 20, 1996

[51] Int. Cl.[6] ..... A63F 5/04; G07F 17/34

[52] U.S. Cl. ..... 463/21; 463/25

[58] Field of Search ..... 463/25, 26, 27, 463/16, 17, 18, 19, 20, 21, 22, 23

[56] References Cited

U.S. PATENT DOCUMENTS

| | | | |
|---|---|---|---|
| 4,095,795 | 6/1978 | Saxton et al. | 273/143 R |
| 4,448,419 | 5/1984 | Telnaes | 273/143 R |
| 4,573,681 | 3/1986 | Okada | 273/143 R |
| 4,624,459 | 11/1986 | Kaufman | 273/143 R |
| 4,669,731 | 6/1987 | Clarke | 273/143 R |
| 4,695,053 | 9/1987 | Vazquez, Jr. et al. | 273/143 R |
| 4,837,728 | 6/1989 | Barrie et al. | 364/412 |
| 4,858,932 | 8/1989 | Keane | 273/143 R |
| 4,991,848 | 2/1991 | Greenwood et al. | 273/143 R |
| 4,993,713 | 2/1991 | Harada | 273/138 A |
| 5,016,880 | 5/1991 | Berge | 273/138 A |
| 5,083,785 | 1/1992 | Okada | 273/143 R |
| 5,580,309 | 12/1996 | Piechowiak et al. | 463/25 X |

FOREIGN PATENT DOCUMENTS

| | | | |
|---|---|---|---|
| 1454046 | 10/1976 | United Kingdom | G07F 17/34 |
| 2131587 | 6/1984 | United Kingdom | G07F 17/34 |

*Primary Examiner*—William H. Grieb
*Attorney, Agent, or Firm*—Bernhard Kreten

[57] ABSTRACT

An apparatus and method for automatically switching between any of a plurality of theoretical expectations on a gaming or amusement device of the kind where the outcome is determined by a combination of random or pseudo-random events yielding an associated score from a table of values. Any one of a plurality of predetermined random "trigger" events will cause the amusement or gaming device to automatically vary the likelihood of certain random events, without altering the associated score for any particular outcome, for a minimum "duration" period. By altering the likelihood of any particular outcome, the device will operate at a different theoretical expectation.

37 Claims, 5 Drawing Sheets

AUTOMATICALLY VARYING MULTIPLE THEORETICAL EXPECTATIONS ON A GAMING DEVICE: APPARATUS AND METHOD

FIELD OF THE INVENTION

This invention relates generally to gaming devices and, in particular, to an apparatus and method for automatically varying multiple theoretical expectations on a gaming device.

BACKGROUND OF THE INVENTION

There are devices known in the prior art that accept wagers, conduct a single or series of random or pseudo-random events and based upon the outcome of those events, determine an associated score from a table of scores. These types of amusement devices or games are generally known as slot machines. Typically, these slot machines utilize multiple rotatable reels or a video display to display a random combination of predetermined indicia.

There are basically three primary methods for determining the outcome of a game in use today: direct, virtual and weighted reel strips. The first method, direct reel strips, has a one-for-one representation of the reel strips in a computer memory which corresponds with a video and/or a physical mechanism display of the reels. If the reels have 22 stops, so does the computer representation of the reels.

The second method, virtual reel strips, has a larger number of possible indicia in memory than appear on the physical and/or video reels. Each virtual stop in memory has associated with it a position on the reel. This virtual reel method allows slot machines to offer substantially higher awards while preserving the low end hit frequencies on the pay table.

The third method, weighted reel strips, is a method of achieving the same goals as the virtual reel strip method. The computer representation of the reel strips has the same number of indicia as the video and/or physical reel strips, but has associated with it a weight or likelihood of being chosen. For example, the reel may offer 20 indicia with only one "SEVEN" and one "CHERRY". In memory, the weight for a "SEVEN" may be a 1 while the weight for a "CHERRY" may be a 5. In this case, the "CHERRY" would be five times as likely to appear in the outcome as a "SEVEN".

These methods are applicable to amusement devices or games commonly referred to as slot machines where a fixed number of indicia is chosen (the number of reels) from a finite set of indicia (the reel strips). The resulting combination of indicia (the outcome) yields a score which is derived from a predetermined table of scores (the pay table).

All slot machines, that we are aware of, today have the following in common: the computer representation of the reel strips never changes during the use of the game without manual intervention (either changing a ROM (read only memory) chip or reprogramming the game to select a different permanent set of reel strips); and the likelihood of each specific outcome is predetermined and never changes during the use of the game without similar manual intervention.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| | ISSUE DATE | INVENTOR |
|---|---|---|
| | U.S. PATENT DOCUMENTS | |
| U.S. Pat. No. | | |
| 4,095,795 | June 20, 1978 | Saxton, et al. |
| 4,448,419 | May 15, 1984 | Telnaes |
| 4,573,681 | March 4, 1986 | Okada |
| 4,624,459 | November 25, 1986 | Kaufman |
| 4,669,731 | June 2, 1987 | Clarke |
| 4,695,053 | September 22, 1987 | Vazquez, Jr, et al. |
| 4,837,728 | June 6, 1989 | Barrie, et al. |
| 4,858,932 | August 22, 1989 | Keane |
| 4,991,848 | February 12, 1991 | Greenwood, et al. |
| 4,993,713 | February 19, 1991 | Harada |
| 5,016,880 | May 21, 1991 | Berge |
| 5,083,785 | January 28, 1992 | Okada |
| | FOREIGN PATENT DOCUMENTS | |
| PATENT NO. | | |
| 1,454,046 | October 27, 1976 | Gatley |
| 2,131,587 | June 20, 1984 | Hagiwara |

U.S. Pat. No. 4,095,795 to Saxton, et al. teaches the use of the above delineated first method, direct reel strips. The major focus of the Saxton, et al., patent is to use a computer number generator to operate the game. The computer representation of the game itself was not a concern.

U.S. Pat. No. 4,448,419 to Telnaes teaches the use of virtual reel strips, the second method described above.

G.B. Patent No. 2,131,587 to Hagiwara teaches the use of an amusement device having a variable payout schedule wherein the payout schedule is selected in accordance with the actual history of the apparatus. In addition, the device toggles between pay tables accordingly. The odds are displayed by the machine prior to the start of each game.

Hagiwara recomputes payout ratios prior to the start of each game and also displays the adjusted payouts prior to the start of the game. The objective of Hagiwara is to reduce variations in short-term initial pay outs to minimize operator liability and is unacceptable by many, if not all, United States gaming jurisdictions regulating bodies. G.B. Patent No. 1,454,046 to Gatley teaches the means for controlling the pay-out ratio over the short-term, that is to say, reducing the possibility of the occurrence of large runs of wins or runs of games in which there is no win.

Gatley and Hagiwara, although implemented differently, are conceptually very similar. They are both intended as a means for limiting the short term initial pay-out of newly installed gaming machines. In Great Britain, operators are not as well capitalized as Nevada style casinos. They are typically small pub owners who cannot afford large payouts or higher than expected early payouts when they first install a machine. Gatley and Hagiwara type games are, therefore, more marketable to operators.

Gatley's invention analyzes the metered payout ratio of the machine and turns a cam either clockwise or counter clockwise to "tighten" or "loosen" the machine accordingly. The adjustment is made either during or just prior to each game. The type of game that the Gatley invention is intended for is a "Nudge" machine where the likelihood of a payout is determined not just by random draw, but also by the skill of the player in nudging the wheels forward or backward. The method of limiting payouts described in Gatley restricts the ability of the player to nudge the wheels. We know of no gaming jurisdiction in the United States where a gaming device of the Gatley type is legal.

The inventions in the prior art that are of the Gatley type, including the Hagiwara invention, analyze prior performance of the machine and limit the payouts so that the initial short term payout of the machines are nearly equal to the long term expected payout. They are not based upon a random trigger, nor do they operate for any duration longer than a single game. Gatley acknowledges that his game might determine to tighten payouts over consecutive games just following a large payoff because the calculations made just prior to each individual game would still individually call for it.

U.S. Pat. No. 4,624,459 to Kaufman teaches the use of a gaming device having random multiple payouts. Kaufman suggests a means for a very specific method for providing a multiple payout paid in addition to a randomly determined number of paid jackpots. A random number is chosen and if the number of winners paid is equal to that random number, the next winner is paid an additional bonus amount. Kaufman does not alter the player's likelihood of hitting a jackpot, but rather provides the means for an additional bonus payout. In addition, Kaufman notifies the player that the next winner will be a bonus if the random number matches the number of winners paid. Kaufman does not provide for a duration of more than one winner per bonus payout.

U.S. Pat. No. 4,669,731 to Clarke teaches the use of a slot machine that offers, in addition to the pay table of simple combinations achievable in a single game, a payout for playing N consecutive games without a payout. Clarke uses a specific random event, and consecutive losses or losers, to generate an immediate payout. In addition, Clarke calls for an apparatus that informs the player of the number of consecutive losers already played. Moreover, Clarke does not store multiple pay tables or alter the internal or external representation of the reel strips or game cycle in any way.

U.S. Pat. No. 4,991,848 to Greenwood, et al., teaches the use of a method for constructing a specific weighting to a fixed pay table. In order to reduce administrative intervention, Greenwood, et al. specifies a type of pay table where a plurality of payouts are set just below the administrative value ($1,200.00 or greater jackpots must be reported individually on separate copies of Form W-2/G). There are different pay tables associated with the number of coins wagered by the player. The maximum coin pay table has a high end jackpot set to twenty times the administrative value.

U.S. Pat. No. 5,016,880 to Berge teaches the use of a game that allows for several targets with associated payouts and hit probabilities. The probability of a hit is not variable and is limited by the mechanics of the game. In order to provide a multiplicity of hold percentages for the game, Berge suggests that a computer could accept a desired level of profitability and vary the payout amount for a target and associate a bonus jackpot with every N hit. N could be either a fixed number or a random number with a mean value such that the sum of possible payouts yields the desired percentage.

Several distinctions should be made here; because the mean value of the number of hits between the special payout is fixed until adjusted by manual intervention through the computer keyboard, the players expectation is constant and equal to the programmed target hold percentage. In other words, this game was designed to let the operator determine his long term hold percentage which, once set, does not vary.

The other prior art listed above, but not specifically discussed, further catalogs the prior art of which the applicant is aware. The present invention diverges even more starkly from the references listed above, but not discussed.

SUMMARY OF THE INVENTION

The instant invention is distinguished over the known prior art in a multiplicity of ways. For one thing, this invention provides an apparatus and method for automatically changing the computer representation of the reel strips regardless of the method used (direct, virtual, weighted, or other), and thus changing the likelihood of each possible outcome. The instant invention is independent of the distribution of jackpots on the pay table and does not alter the pay table, but rather the likelihood of hitting a winning combination on the pay table.

In addition, this invention is the only invention known to employ a random or pseudo-random "trigger" event to alter a player's expectation based upon the occurrence of a random or pseudo-random event for a specified "duration". The trigger event may be a random or pseudo-random event which happened on a specific gaming device, on another gaming device or that was determined by a host computer system and then communicated back to the specific gaming device. Also, in addition to random events particular to the game, the random event or events may be particular to a current player. The current player either identifies himself via an insertion of a player card into a reader or some other electronic method, or a computer determines a new player by monitoring an elapsed period of time between games played and comparing playing speeds, handle pulls per unit time, between the current player and a previous player. The trigger may be a predetermined random event or combination of predetermined random events such as a predetermined outcome or a finite series of consecutive outcomes with a total score of zero.

The instant invention uses any of a multiplicity of triggers to change the player's expectation for the specified duration of play. Instead of paying out immediately, the instant invention offers a greater possibility of hitting a winner over a greater duration of play.

Once the trigger event occurs, the instant invention is placed in an "Incentive Mode" wherein a microprocessor or processing means modifies its representation of the reel strips in memory by any of a number of methods. For example, by switching reel strips from different tables already defined in memory, adjusting the number of stops per reel, adjusting the number of possible indicia on its current reel strips, modifying the number of occurrences of pay indicia on the current reels strips, or modifying the weights of symbols on the current reel strips.

The instant invention is further distinguished over the known prior art by providing the ability to change the internal representation of the reel strips for any reason including the specific reason of offering the Incentive Mode.

Furthermore, once in the Incentive Mode, the game will continue to operate the new resulting strips for the "duration" that will end when any one of a combination of factors has occurred such as the expiration of a timer, or the occurrence of a predetermined random event, or the completion of a predetermined finite number of games played.

This Incentive Mode concept offers a bonus to players by increasing the player's expectation for the duration period. This Incentive Mode provides the means for leaving the game in a higher frequency hit mode for the duration period thereby stimulating player excitement and play. After the duration period, the game will assume its original representation of the reel strips until the next trigger event occurs.

The instant invention is based upon the occurrence of this random trigger and not the past performance of the machine. In addition, the player is not necessarily assured of hitting a winner even while the game is in this "Incentive Mode".

Manufacturers and operators of slot machines realize that these are amusement devices and that profitability correlates directly with perceived entertainment value by the player or customer. By offering a "dynamic" theoretical expectation on the game, game designers have more power and control to offer a more exciting playing session for the player. If a player is suffering from a series of consecutive losses, the game might switch into a more liberal set of likely outcomes for the "duration". This would tend to stimulate the player's interest in continuing with the play of the game. Ostensibly, players will invest more time and money on those games where they perceive a greater entertainment value.

OBJECTS OF THE INVENTION

A primary object of the present invention is to provide a new and novel method for improving gaming devices so that players are encouraged to wager more betting units and continue to play for an extended period of time.

A further object of the present invention is to provide a method of accomplishing the primary objective by introducing a greater likelihood of short-term payouts for a limited duration period.

Another further object of the present invention is to control the mixture of penalties (losers) and rewards (winners) to allow players to enjoy greater amusement from playing the improved devices.

Another further object of the present invention is to contain a plurality of likelihoods for random or pseudo-random events which comprise the play of games which are stored in a memory.

Another further object of the present invention is that once a predetermined random or pseudo-random trigger event occurs, the device will switch from its default representation of event likelihoods to its incentive mode representation of likelihoods, and continue play as normal.

Another further object of the present invention is that once the device is in incentive mode it continues to operate in this mode until anyone of a plurality of duration counters expires.

Another further object of the present invention is to conceal the current game mode in order to subliminally offer greater excitement to the player at random intervals.

These and other objects will be made manifest when considering the following detailed specification when taken in conjunction with the appended drawing figures.

DESCRIPTION OF PREFERRED EMBODIMENTS

Figure 1:
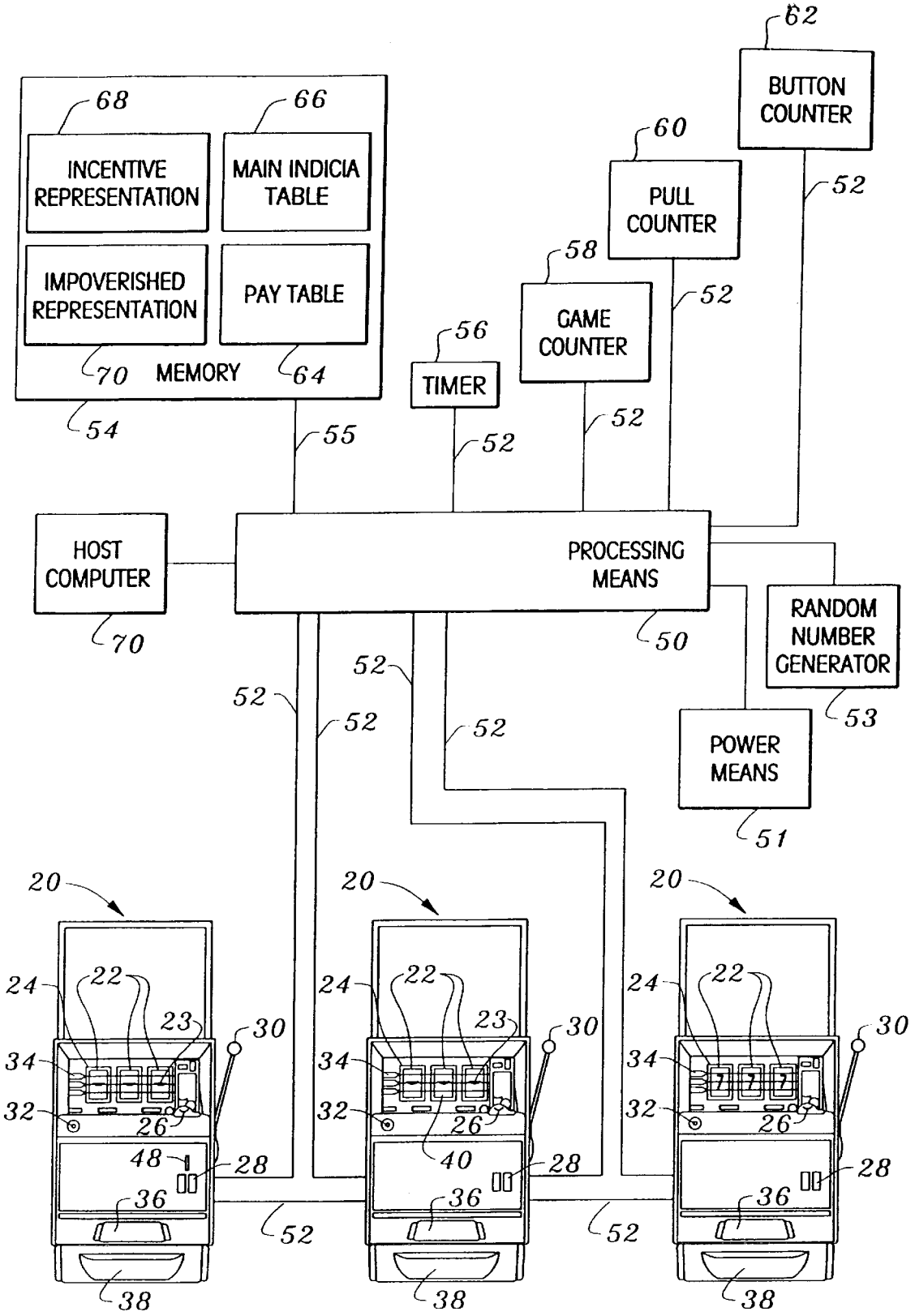
FIG. 1 is a block diagram of an apparatus for automatically varying multiple theoretical expectations on a gaming device in accordance with the principles of the instant invention.

Considering the drawings, wherein like reference numerals denote like parts throughout the various drawing figures, reference numeral 10 is directed to an apparatus for automatically varying multiple theoretical expectations on a gaming device according to the present invention.

In essence, and referring to FIG. 1, the apparatus 10 is provided for automatically varying multiple theoretical expectations on one or more gaming devices 20. Each of these gaming devices 20 may embody a conventional or familiar wagering game, such as video poker or a spinning three reel-type wagering device known in the art. Preferably, the outcome of each gaming device 20 is determined by a combination of random or pseudo-random events yielding an associated score from a table of scores. The apparatus 10 responds to at least one random or pseudo-random "trigger" event to automatically vary the likelihood of certain random events, without altering the associated score for any particular output, for a period of time or some other "duration". For example, a "normal" default mode may be a state where a hit rate for the pay table coincides with a long term expectation. Once the trigger event occurs, the apparatus 10 is placed in an "incentive mode" which provides a hit rate for the pay table which is greater than the hit rate in the normal default mode. Alternatively, the trigger event may prompt a mode which is neither the normal mode nor the incentive mode. One example of this may be an "impoverished mode" which provides a hit rate for the pay table which is less than the hit rate in the normal default mode. By altering the likelihood of any particular outcome, the gaming device 20 will operate at a different theoretical expectation.

Typically, each reel-type of gaming device 20 includes a plurality of mechanical rotatable reels 22 each of which is provided with an annular row having various indicia 23 thereon. The annular row of indicia is often referred to as a reel strip. The indicia 23 are viewable through a window 24. Alternatively, gaming device 20 may employ a video display 40 to display the indicia 23 and to simulate the action of the mechanical rotatable reels 22 and to display indicia 23 via window 24. Furthermore, the video-type of gaming machine 20 may be of a type which plays a table game such as poker, "craps", or the like. Today, most gaming devices 20 are electronically controlled.

In both the mechanical and video type of gaming devices 20, a player makes a wager by inserting a token, which may be a coin or the like into a slot 26, or by scanning a player card 48 through a reader 28 located on the gaming device 20. The player then actuates the gaming device 20 by pulling a handle 30 or pressing a button 32 on the gaming device 20. Upon actuation of the handle 30 or the button 32, the gaming device 20 starts the reels 22 or the video display in motion. After the reels 22 have stopped or after the video display has stabilized, certain combinations of indicia 23 will appear adjacent at least one win line 34. The resulting combination of indicia 23 (the outcome) appearing adjacent the win line 34 yields a score which is derived from a predetermined table of scores (the pay table 64). Typically, if a combination of indicia 23 along the win line 34 corresponds to a winning combination, a corresponding number of coins or tokens are paid out through a chute 36 of the gaming device 20 and into a tray 38. Alternatively, the corresponding winnings may be credited to the account of the person using the player card 48.

A plurality of methods are in use today for determining the outcome of a gaming device 20. For example, a direct reel strip method includes a one for one representation of the reel strips in memory of a computer or processing means which corresponds with the video and/or physical mechanism display of the reels. For example, if the video or mechanical reels have twenty-two stops spaced about the reel, the computer representation represents these twenty-two stops in memory.

A virtual reel strip method has a larger number of possible indicia in memory than appear on the physical or video reels. Each virtual stop in memory has associated with it a position on the reel.

A weighted reel strip method achieves the same goal as the virtual reel strip method. The computer representation of the reel strips has the same number of indicia as the physical or video reel strips, but has associated with it a weight or likelihood of being chosen.

The apparatus 10 is capable of automatically changing the representation of the reel strips 22 regardless of the method used (direct, virtual, weighted or other). Thus, the apparatus 10 changes the likelihood of each possible outcome. Note that the apparatus 10 is independent of the distribution of jackpots on the pay table 64 and does not alter the pay table 64, but rather the likelihood of hitting a winning combination on the pay table 64.

The apparatus 10 will allow the gaming device 20 to operate in a normal default mode until a predetermined random or pseudo-random "trigger" event occurs. The trigger event may be a random or pseudo-random event which happened on one specific gaming device 20, on another gaming device 20, on a host computer 70 or that was determined by a processing means 50 and then communicated back to the specific slot machine via communication lines 52.

Also, in addition to random or pseudo-random events particular to the game, the random event or events may be particular to a current player. For example, the current player may be identified via the use of the player card 48 scanned by the reader 28 or by some other electronic method. In addition, a new player may be automatically identified by using the processing means 50 for monitoring an elapsed period of time between games played and comparing playing speeds, handle pulls or button pushes per unit time, between the current player and a previous player.

The trigger events may be the occurrence of a predetermined random or pseudo-random event. For example, the trigger may be a predetermined random event or a combination of predetermined random events such as a predetermined unique outcome, consecutive outcomes with a total score of zero or a certain number of consecutive winning or losing outcomes. The key is that they be predetermined random or pseudo-random events. A random number generator 53 may be employed to provide a random event.

Once the trigger event occurs, the apparatus 10 is automatically placed in an "incentive mode" wherein the processing means 50 modifies by any of a number of methods, its representation of the game 20 in an associated memory 54 may be accessed by the processing means 50 via data bus 55. For example, by switching reel strips from different tables already defined in the memory 54, adjusting the number of virtual stops per reel defined in the memory 54, adjusting the number of possible indicia defined in memory 54 corresponding to the current reel strips on the rotatable or video reels 22. In addition, the processing means 50 may modify the number of occurrences of indicia which correspond to a pay off on the current reel strips or the weights of the indicia on the current reel strips. The apparatus 10 has the ability to change the internal representation of the game for any reason including the specific reason of offering the incentive mode.

Preferably, the score for outcomes, generally referred to as the pay table, is never altered. Also, each winning combination shown on the pay table is always available; however, the likelihood of achieving certain combinations will vary depending upon the game mode.

Furthermore, once in the incentive mode, the game will continue to operate the new resulting strips for a duration period that will end when at least one of a combination of factors has occurred such as the expiration of a timer 56, a completion of a predetermine finite number of games played, a certain number of winning outcomes or consecutive winning outcomes, or the occurrence of a predetermined random or pseudo-random event. The importance of the duration is to provide a measured limitation on the incentive mode play. In case of multiple durations, it is preferred that the default mode will resume as soon as any duration expires.

By operating in the incentive mode, the apparatus 10 offers a bonus to players by increasing the player's expectation for the duration period. In addition, the apparatus 10 provides the means for leaving the game in a higher frequency hit mode for the duration period thereby stimulating player excitement and play.

After the duration period, the game will assume its original representation of the reel strips until the next trigger event occurs. Note that the incentive mode is based upon the occurrence of this random trigger and not the past performance of the gaming machine 20. In addition, the player is not necessarily assured of hitting a winning combination even while the gaming device 20 is in this incentive mode.

Figure 2:
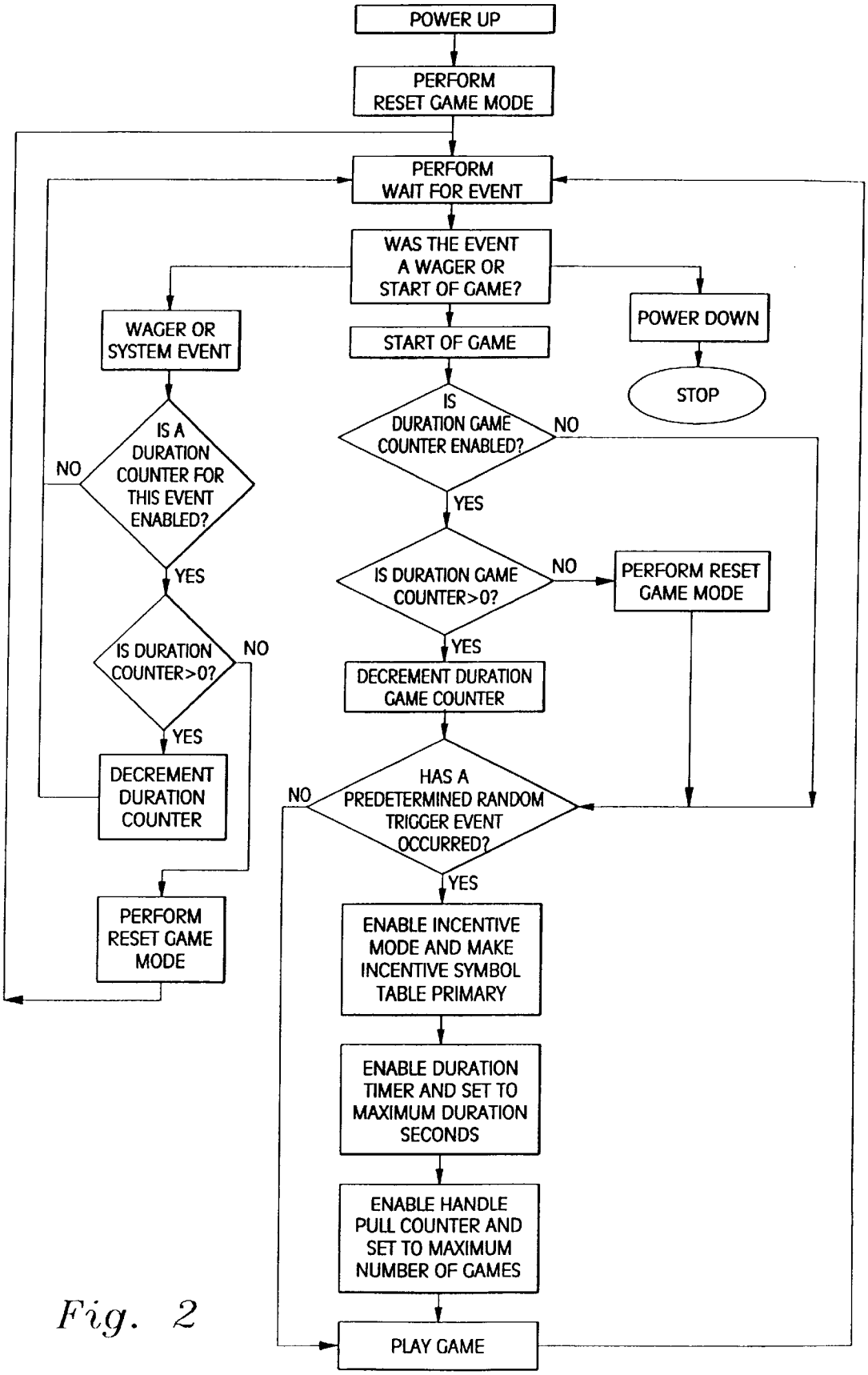
FIG. 2 is a flow chart illustrating the main logic of the invention for automatically varying multiple theoretical expectations on a gaming device.
Figure 3:
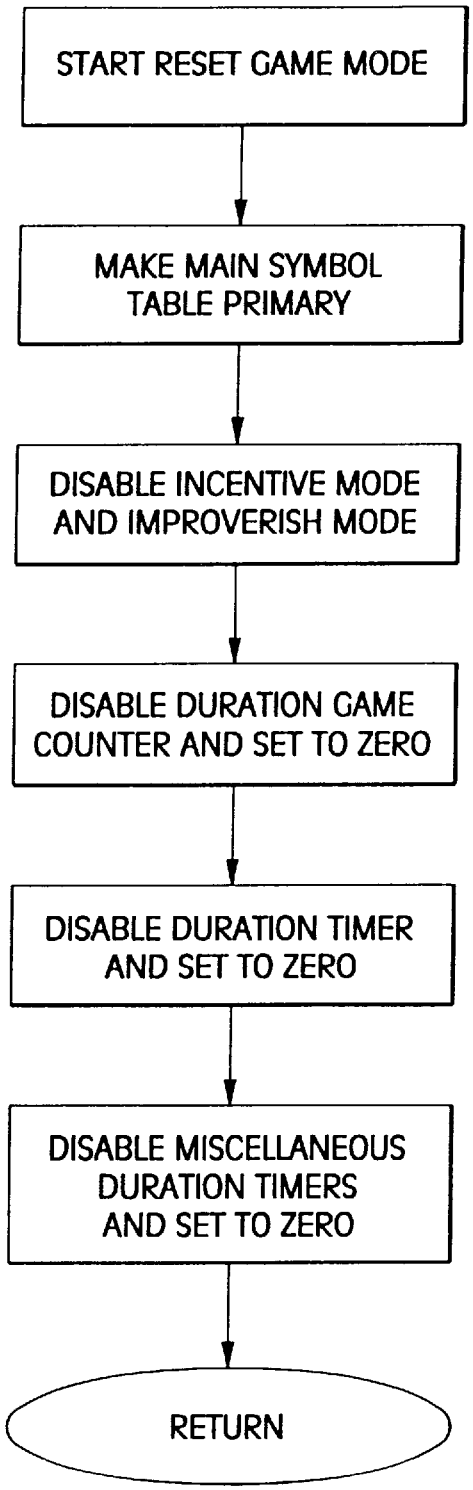
FIG. 3 is a flow chart illustrating the steps necessary for performing a reset game mode operation.

Referring to FIG. 2, a flow chart is shown which delineates the method the apparatus 10 uses for automatically varying multiple theoretical expectations on a gaming device 20. On power up, the system 10 performs a reset game mode operation which is detailed in FIG. 3. The first step in the reset game mode operation is to make a main indicia table 66 defined in memory 54, the primary table. That function causes a default set of probabilities for random events to be loaded as the primary set of probabilities to be used in the current game. The incentive mode is disabled at this time and any duration timers 56 or game counters 58 are also disabled.

Figure 4:
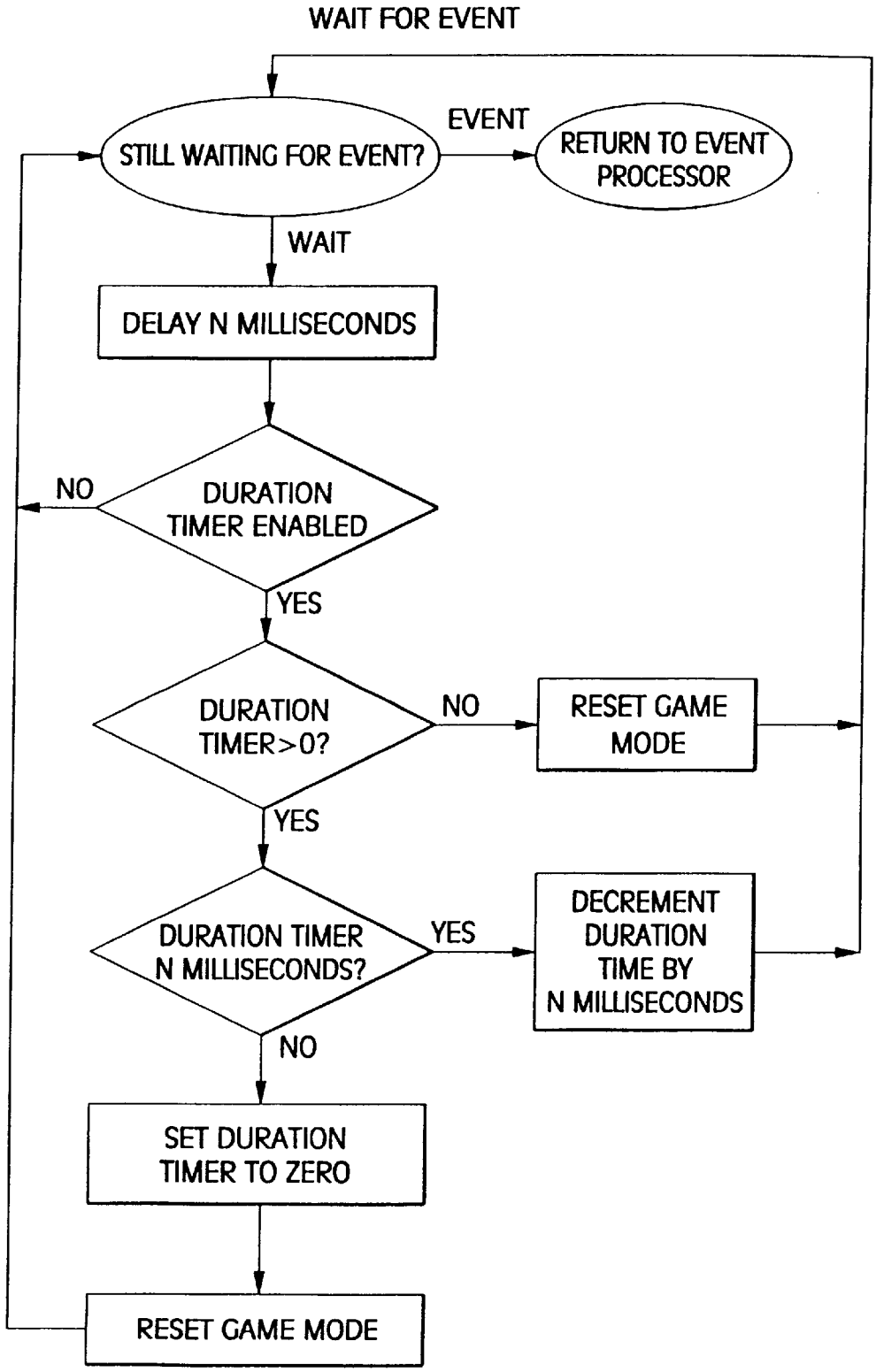
FIG. 4 is a flow chart illustrating a method for waiting for events while maintaining a duration timer.

The next operation performed is a wait for event operation which is detailed in FIG. 4. The wait for event operation is an implementation of a timer duration which is one of the pluralities of possible durations. For example, while waiting for an event to occur, such as a wager or start of game signal, the device will delay for "N" milliseconds. If the duration timer 56 is enabled the duration time remaining will be decremented by the "N" millisecond delay period but will not be decremented below a zero value. Once the duration timer 56 expires, a reset game mode operation is performed.

Referring back to FIG. 2, any number of a plurality of events might occur. However, for the purpose of this discussion, three event classifications are considered. First, the wager or other system event is any event that may be pertinent to a duration counter number or timer other than the duration timer 56 and game counter 58. The logic is to decrement the maximum number of allowable events and to perform a reset game mode operation if a timer or counter expires; otherwise, continuing waiting for the next event.

The second classification of events is the start of game event. It is at this point that the apparatus 10 must verify which mode it is to employ when performing its series of random or pseudo-random events. The apparatus 10 will then determine if any duration game counter 58 based on the number of games played has been enabled. If the duration game counter 58 has been enabled the processing means 50 of the apparatus 10 will determine if the duration game counter 58 is greater than zero. If the duration game counter 58 is not greater than zero a reset game mode operation will be performed. If it has been determine that the duration game counter 58 is greater than zero, the counter will be decremented and operation will continue.

Next, the apparatus 10 will test to see if any of a plurality of predetermined trigger events has occurred. If a trigger event has in fact occurred, the incentive mode will be enabled and the processing means 50 modifies, by any of a number of methods described above, its representation of the reel strips. At this time the duration timer 56 will be enabled and set to a maximum duration time. An enable handle pull counter 60 and/or button push counter 62 is also set to a maximum number of games. For analysis of possible trigger events, the apparatus 10 may conduct its own procedures for playing the game which would include determining the outcome and applying the appropriate score. Note that the instant invention does not materially alter the operation of the method of conducting the play of game, but rather would only point to a default or an incentive mode internal representation of the physical game and continue operation.

Figure 5:
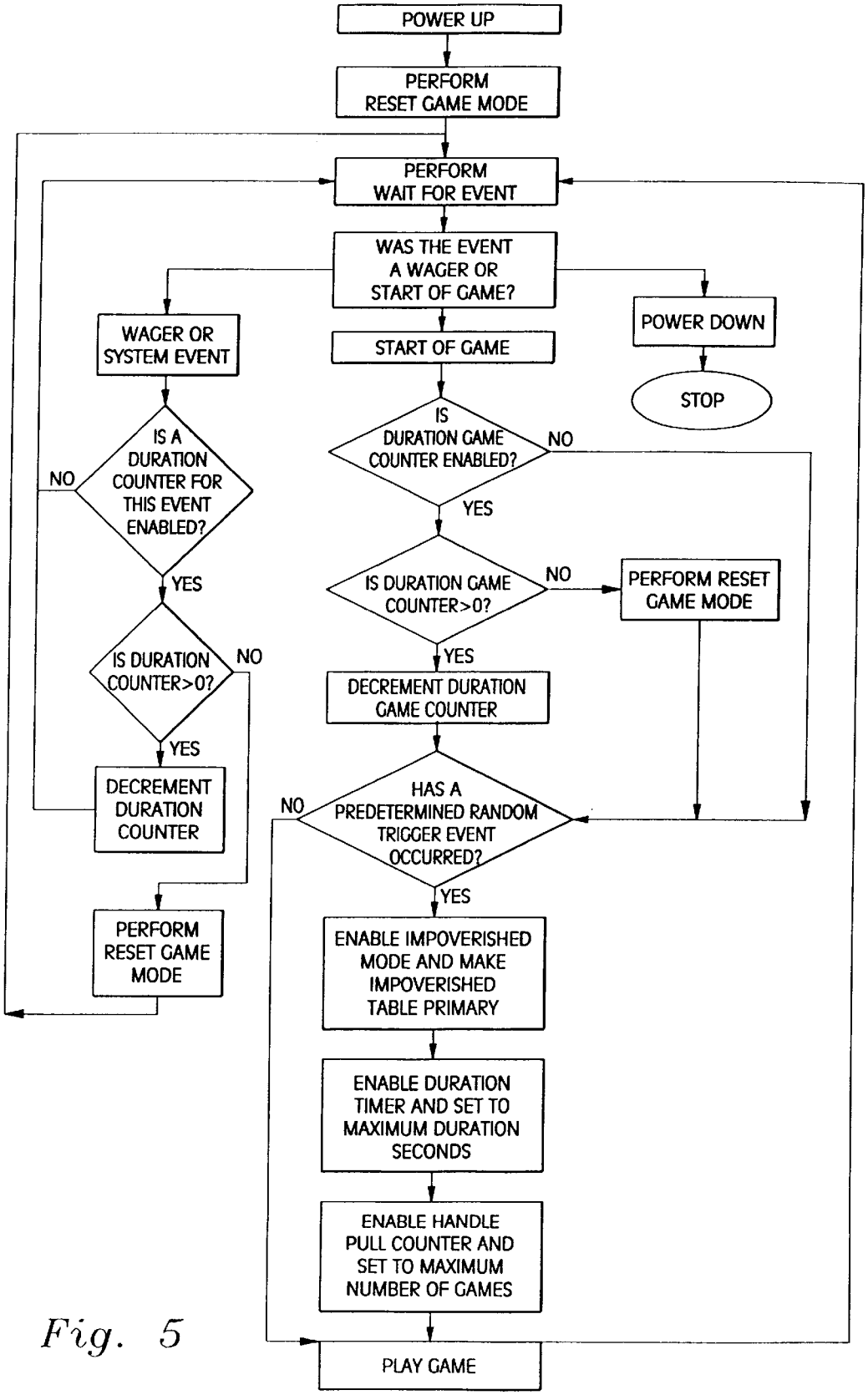
FIG. 5 is a flow chart of a second embodiment of that which is shown in FIG. 2.

FIG. 5 is identical to FIG. 2 with the exception that the impoverished mode of game representation is enabled upon the occurrence of the trigger event rather than the incentive mode being enabled. Thus, the description supra with respect to FIG. 2 also details FIG. 5 when one notes that the impoverished mode in FIG. 5 replaces the incentive mode in FIG. 2.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. An apparatus for automatically varying multiple theoretical expectation on a gaming device; comprising in combination:

processing means including an associated memory means;

said processing means operatively coupled to at least one gaming device;

a default representation mode of at least one said gaming device stored in said memory means;

an incentive representation mode of at least one said gaming device stored in said memory means;

means for providing a trigger event;

said processing means responding to said trigger event by changing said default representation mode to said incentive representation mode of at least one said gaming device whereby multiple theoretical expectation on at least one said gaming device is varied; and means for concealing the current game representation mode from a player for subliminally offering greater excitement to the player.

2. The apparatus of claim 1 wherein said incentive representation mode of at least one said gaming device is maintained for a duration period and based on an incentive representation pay table.

3. The apparatus of claim 2 wherein said processing means includes means for changing said incentive representation mode based on said incentive pay table to said default representation mode based on a default representation pay table separate and distinct from said incentive representation pay table when said duration period has ended.

4. A method for automatically varying multiple theoretical expectations on a gaming device, comprising the steps of:

providing a power source, providing a processing means operatively coupled to the gaming device and to the power source, providing a memory means associated with the processing means and including a default representation pay table and a separate incentive representation pay table of the gaming device stored therein, starting a game on the gaming device when a start of game event occurs, determining the occurrence of a trigger event;

enabling the incentive representation pay table of the gaming device when the occurrence of the trigger event has been determined; and concealing the current gaming device representation from a player for subliminally offering greater excitement to the player at random intervals.

5. The method of claim 4 including the step of communicating a signal from the processing means to the gaming device for performing a reset game mode operation when the power source is activated.

6. The method of claim 5 including the step of performing a wait for event operation.

7. The method of claim 6 including the step of determining when an event has occurred.

8. The method of claim 7 including the step of distinguishing what event has occurred.

9. The method of claim 8 including the step of providing a game counter in communication with the processing means.

10. The method of claim 9 including the step of determining if the game counter is enabled upon the occurrence of the start of game event.

11. The method of claim 10 including the step of determining if said game counter is greater than zero upon the occurrence of the start of game event.

12. The method of claim 11 including the step of decrementing the game counter when the game counter is greater than zero.

13. The method of claim 12 including the step of providing a timer in communication with the processing means.

14. The method of claim 13 including the step of setting said timer to a maximum duration if the trigger event has occurred.

15. The method of claim 14 including the step of performing a wait for event operation after play of game has ended.

16. The method of claim 15 including the step of powering down said device if an event has occurred which is not the start of game event or a wager event.

17. The method of claim 16 including the step of determining if the game counter is enabled when the wager event occurs.

18. The method of claim 17 including the step of evaluating said game counter when the wager event occurs.

19. The method of claim 18 including the step of decrementing the game counter if the game counter reveals a count greater than zero.

20. The method of claim 19 including the step of returning to said wait for event operation when the wager event occurs and after said game counter is decremented.

21. The method of claim 20 including the step of performing said reset game mode operation if the game counter reveals a count less than or equal to zero.

22. The method of claim 21 including the step of determining if the trigger event has occurred when the game counter is not enabled.

23. The method of claim 22 including the step of starting the play of game after the game counter is determined to be disabled and trigger event has not occurred.

24. An apparatus for automatically varying multiple theoretical expectation on a gaming device; comprising in combination:

a processing means including an associated memory means;

said processing means operatively coupled to said gaming device;

means for identifying a particular player operatively coupled to said gaming device;

a first representation mode of said gaming device stored in said memory means;

a second representation mode of said gaming device stored in said memory means;

means for providing a trigger event correlative to the particular player identified;

said processing means responding to said trigger event by changing said first representation mode to said second representation mode of said gaming device whereby multiple theoretical expectation on said gaming device is varied.

25. The apparatus of claim 24 wherein said first representation mode is a default mode having a winning hit rate on a default pay table which coincides with a long term expectation.

26. The apparatus of claim 25 wherein said second representation mode is an impoverished mode having a winning hit rate on a impoverished pay table which is separate and less than said winning hit rate on said default pay table.

27. The apparatus of claim 26 wherein said impoverished mode is maintained for a duration period once said trigger event has occurred.

28. The apparatus of claim 25 wherein said second representation mode is an incentive mode having a winning hit rate on an incentive pay table which is separate and greater than said winning hit rate on said default pay table.

29. The apparatus of claim 28 wherein said incentive mode is maintained for a duration period once said trigger event has occurred.

30. The apparatus of claim 24 wherein said means for identifying a particular player includes a card reader operatively coupled to said gaming device and a player card particular to the player scanned by said card reader.

31. The apparatus of claim 24 wherein said means for identifying a particular player includes means for automatically identifying a new player by using said processing means for monitoring an elapsed period of time between games played and comparing playing speeds between a current player and a previous player.

32. An apparatus for automatically varying multiple theoretical expectation on a gaming device; comprising in combination:

a processing means including an associated memory means;

said processing means operatively coupled to said gaming device;

a plurality of representation modes of said gaming device stored in said memory means;

said plurality of representation modes including a default mode, an incentive mode and an impoverished mode;

means for providing a trigger event;

said processing means responding to said trigger event by changing one said representation mode to another said representation mode of said gaming device whereby multiple theoretical expectation on said gaming device is varied.

33. The apparatus of claim 32 wherein said plurality of representation modes includes said default mode having a winning hit rate for a pay table which coincides with a long term expectation.

34. The apparatus of claim 33 wherein said plurality of representation modes further includes said incentive mode having a winning hit rate for said pay table which is greater than said winning hit rate in said default mode.

35. The apparatus of claim 34 wherein said plurality of representation modes further includes said impoverished mode having a winning hit rate for said pay table which is less than said winning hit rate of said default mode.

36. The apparatus of claim 35 wherein said trigger event means includes a first trigger event which prompts said processing means to change said default mode to said incentive mode representation of said gaming device.

37. The apparatus of claim 36 wherein said trigger event means includes a third trigger event which prompts said processing means to change said default mode to said impoverished mode representation of said gaming device.

* * * * *